United States Patent [19]

Diluiso et al.

[11] 4,070,960

[45] Jan. 31, 1978

[54] APPARATUS FOR PACKING FLAT ARTICLES

[75] Inventors: Arthur A. Diluiso, Beverly, Mass.;

[73] Assignee: Post Machinery Company, Inc., Beverly, Mass.

[21] Appl. No.: 716,951

[22] Filed: Aug. 23, 1976

[51] Int. Cl.[2] ..... B30B 15/14

[52] U.S. Cl. ..... 100/49; 100/3; 100/226

[58] Field of Search ..... 100/226, 49, 232, 48, 100/295; 53/124 D, 219

[56] References Cited

U.S. PATENT DOCUMENTS

| | | | |
|---|---|---|---|
| 466,075 | 12/1891 | Brown | 100/232 |
| 740,852 | 10/1903 | Henry | 53/219 |
| 766,557 | 8/1904 | Uhlenkott | 100/232 |
| 3,777,657 | 12/1973 | Crandlemire | 100/49 |

*Primary Examiner*—Billy J. Wilhite

*Attorney, Agent, or Firm*—Fitch, Even, Tabin & Luedeka

[57] ABSTRACT

Apparatus for packing rows of flat articles, such as side-seamed folding carton blanks, in a box. A flat table top is provided with a cavity in the packing region which receives interchangeable inserts. Sets of rear abutment fingers and front compression fingers are mounted for vertical movement between hidden retracted positions and operative raised positions protruding through apertures in an insert. When the operator slides a first row of blanks to the packing region, a switch in the table surface causes a moveable wall to be extended and the rear fingers to rise. Another switch near the rear fingers causes a modular drive mechanism to extend the front fingers and then move them longitudinally to compress the row of articles. A nozzle blows a stream of air across the insert to hold a divider in place against the edge of the compressed row. A second row is then arranged against the next set of rear fingers and the divider, as a second set of front fingers extend and then compress the second row. After a box is placed over the aligned rows, all fingers are automatically withdrawn. By substituting interchangeable insert plates and rearranging the compression finger modules, either one or three or more rows of articles can be packed.

5 Claims, 16 Drawing Figures

APPARATUS FOR PACKING FLAT ARTICLES

The present invention relates to the packing of flat articles in a box or the like and more particularly to apparatus for the high-speed packing of multiple stacks of folding carton blanks in a shipping container.

Paperboard converters routinely produce side-seamed foldng cartons by automatically feeding die-cut paperboard carton blanks to a high-speed folder-gluer. These side-seamed cartons are delivered in their flattened condition in an endless stream from the discharge of the folder-gluer, and they generally must be collected and packed for shipment to the customer, who then fills the cartons with his product. U.S. Pat. No. 3,777,657, which issued on Dec. 11, 1973 discloses a packing apparatus adapted to assist an attendant in efficiently packing identical folding carton blanks, or like flat articles, which are delivered by a conveyor from a folder-gluer or some other source. Apparatus of this design has proved commercially useful for packing such blanks in a suitable shipping container or the like; however, use of the apparatus has shown the need for improvements in its operation.

It is an object of the present invention to provide improved apparatus for packing stacks of flat articles in boxes. Another object of the invention is to provide improved apparatus for the efficient packing of two or more stacks or rows of flat articles in a single box with dividers disposed, if desired, between adjacent rows. A further object of the invention is to provide improved apparatus for packing a number of rows of folding carton blanks in a box which apparatus can be relatively quickly adjusted to adapt it for the packing of a different number of rows of flat blanks.

These and other objects of the invention will be apparent from the following detailed description of certain preferred embodiments, particularly when read in conjunction with the accompanying drawings wherein.

Basically, the invention provides an apparatus which has a flat, upper, table-like surface supported upon a suitable frame which has a receiving region at one end and a packing region at the other end. A large, generally rectangular cavity is provided in the upper surface in the packing region which is adapted to receive and support any one of several interchangeable inserts. The inserts are designed to facilitate the packing of one, two, three or even more rows of flattened folding carton blanks or other flat articles. The overall design is such that there are sets of fingers which move between extended and retracted positions which support and compress the rows of flat articles in position for packing in a shipping container or the like, and the devices for operating these fingers are constructed in module form so that their positions can be quickly and simply adjusted to register with a particular table-top insert that is being employed.

Figure 1:
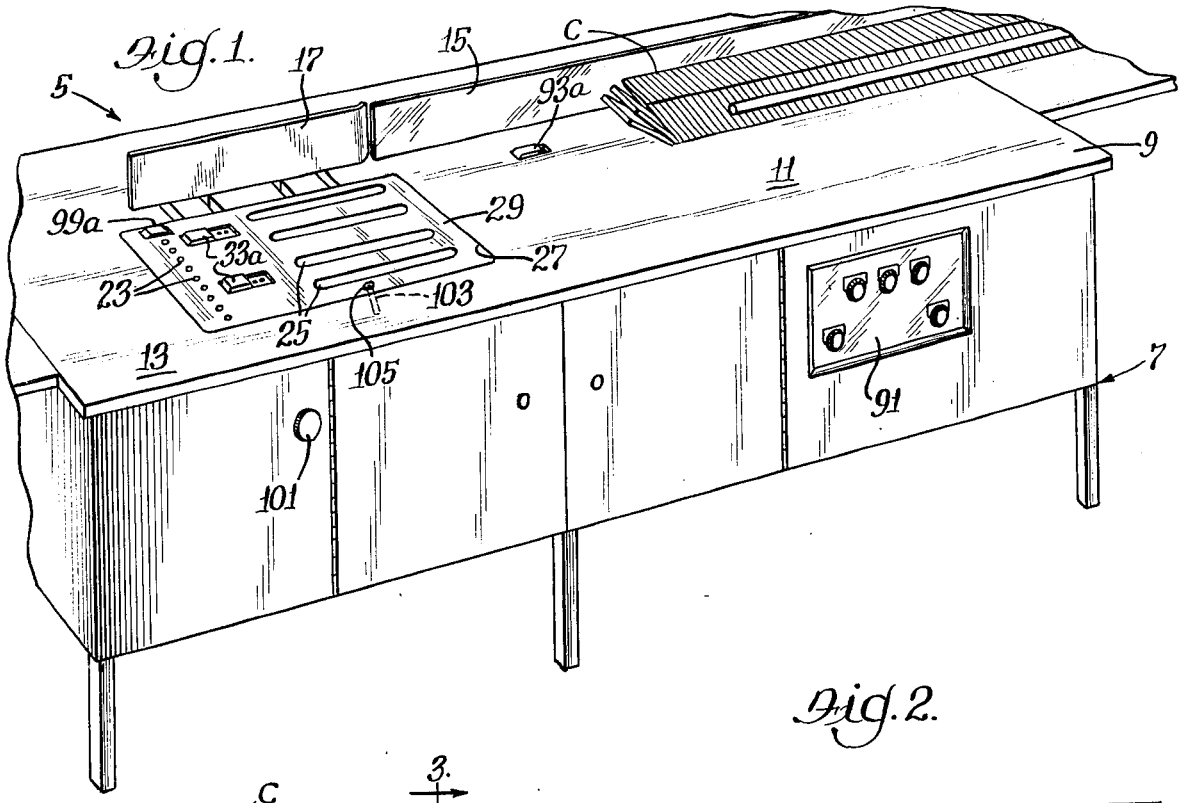
FIG. 1 is a perspective view of apparatus embodying various features of the invention.

Shown in FIG. 1 is a packing apparatus 5 which is formed with a supporting frame 7 which carries a number of vertical panels that make it into a cabinet and upon which a table top 9 is supported, having an upper surface upon which the packing functions take place. The apparatus 5 is designed to be positioned adjacent a folding carton folder-gluer equipped with an edge-stacking device which is adapted to discharge an endless row or stack of flattened side-seamed cartons. Moreover, such stacking devices can be set to count any desired number of folded blanks, and when the preselected count of cartons is reached, a carton is displaced or kicked upward to give a visual indication of that number of cartons in the row. The endless row of carton blanks C is delivered to a receiving region 11 along the right-hand end of the table top from which the preselected count is taken by the attendant and manually moved to the left-hand or packing region 13. The row of incoming cartons is adjacent a rear upstanding backing plate 15, which has a moveable section 17 along its left hand end thereof, the function of which is described hereinafter.

Disposed within the cabinet and supported on the frame 7 are mechanisms for extending and retracting a plurality of rear abutment fingers 19 and front compression fingers 21 which are designed to be raised upward above the upper surface of the table top 9 to hold the row or stack of cartons in the desired alignment for packing. In addition to extending upward above the surface, the front compression fingers 21 are also movable to the left, toward the rear abutment fingers 19, so as to squeeze the row of carton blanks C so that it occupies only a predetermined length.

The rear abutment fingers 19 are stationary longitudinally, and they extend upward through round holes 23 in the surface. To accommodate the longitudinal compressing movement of the front compression fingers 21, elongated apertures 25 or slots in the upper surface. The slots 25 are longer than needed simply for the compressive movement, and the additional length of the slots 25 permits adjustment of the apparatus 5 so as to accommodate the packing of rows of carton blanks or other flat articles in boxes of different lengths, as explained hereinafter.

The table top 9 is formed with a cavity 27 in the region 13 where the packing takes place, and the cavity 27 is filled with one of several interchangeable inserts 29 which are supplied as a part of the apparatus. The inserts 29 are designed to accommodate the use of the apparatus 5 to pack one, two or three rows of carton blanks in a single box, and it should be understood that further duplication would permit the packing of four or more rows if desired. The interchangeable insert plates 29 are supported in the cavity 27 in any suitable manner, as by the provision of flat brackets or supporting plates 31 at the four corners of the cavity upon which the insert plates can rest.

An insert plate 29 designed for the packing of two rows of carton blanks is shown in FIGS. 1 through 4, and an interchangeable plate 29' designed for the packaging of three rows of carton blanks is depicted in FIGS. 11 through 16. Each of the insert plates 29 and 29′ contains a transversely extending row of spaced-apart round holes 23 through which the abutment fingers 19 can protrude. It should be understood that all of the holes 23 are not utilized at a single time, but the fingers 19 will be arranged as desired in alignment with selected holes to appropriately support the rows when carton blanks of different dimensions are bieing packed. The insert plate also contains a set of two slots 25 for each row of carton blanks that will be packed, and one compression finger 21 will travel in each slot. Moreover, an electrical switch 33 is provided in alignment with each set of slots 25, which is located generally adjacent the transverse row of round holes 23.

Figure 2:
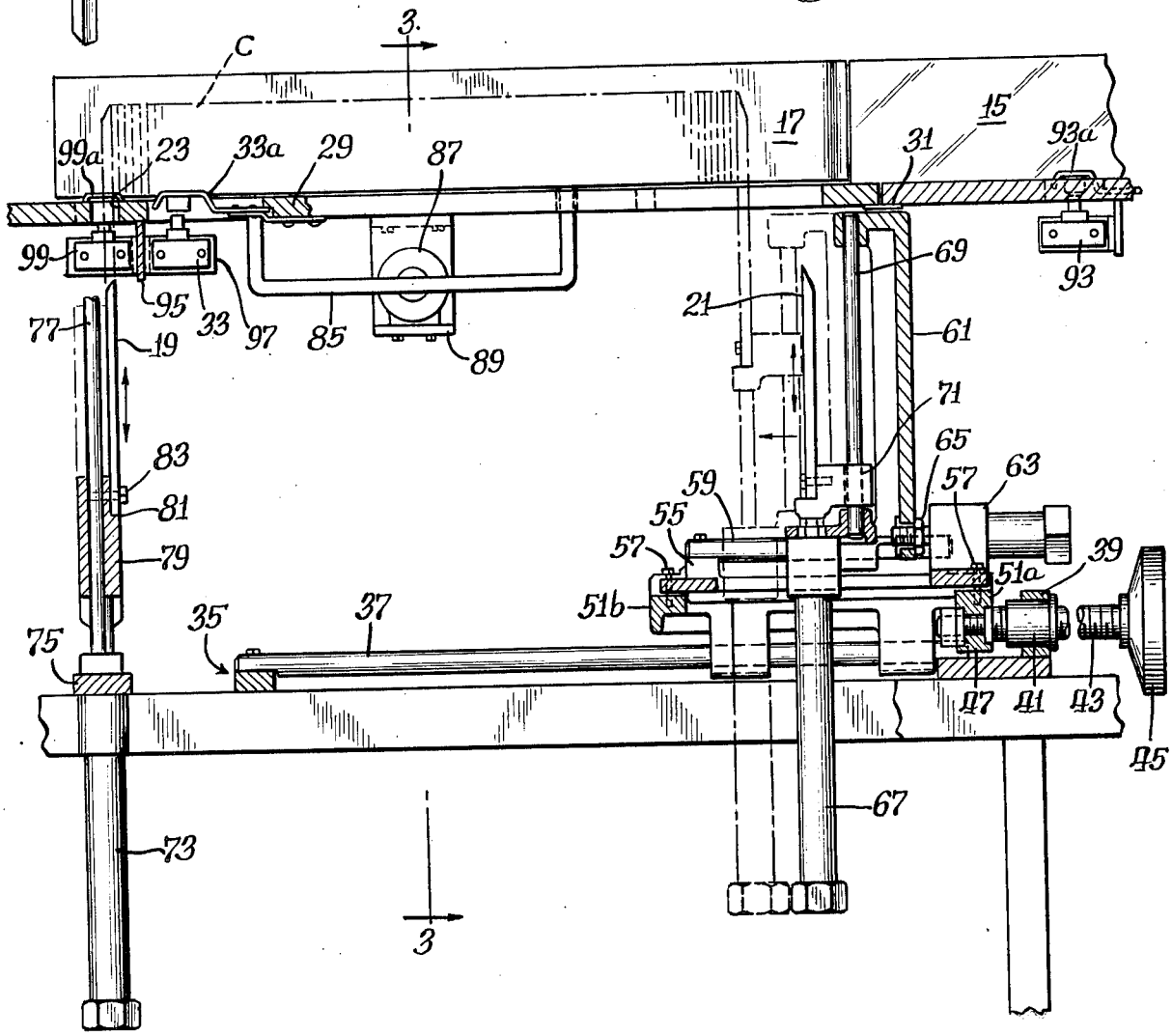
FIG. 2 is an enlarged, fragmentary, front elevation view of the apparatus shown in FIG. 1, with certain portions being broken away and other portions being shown in section.
Figure 3:
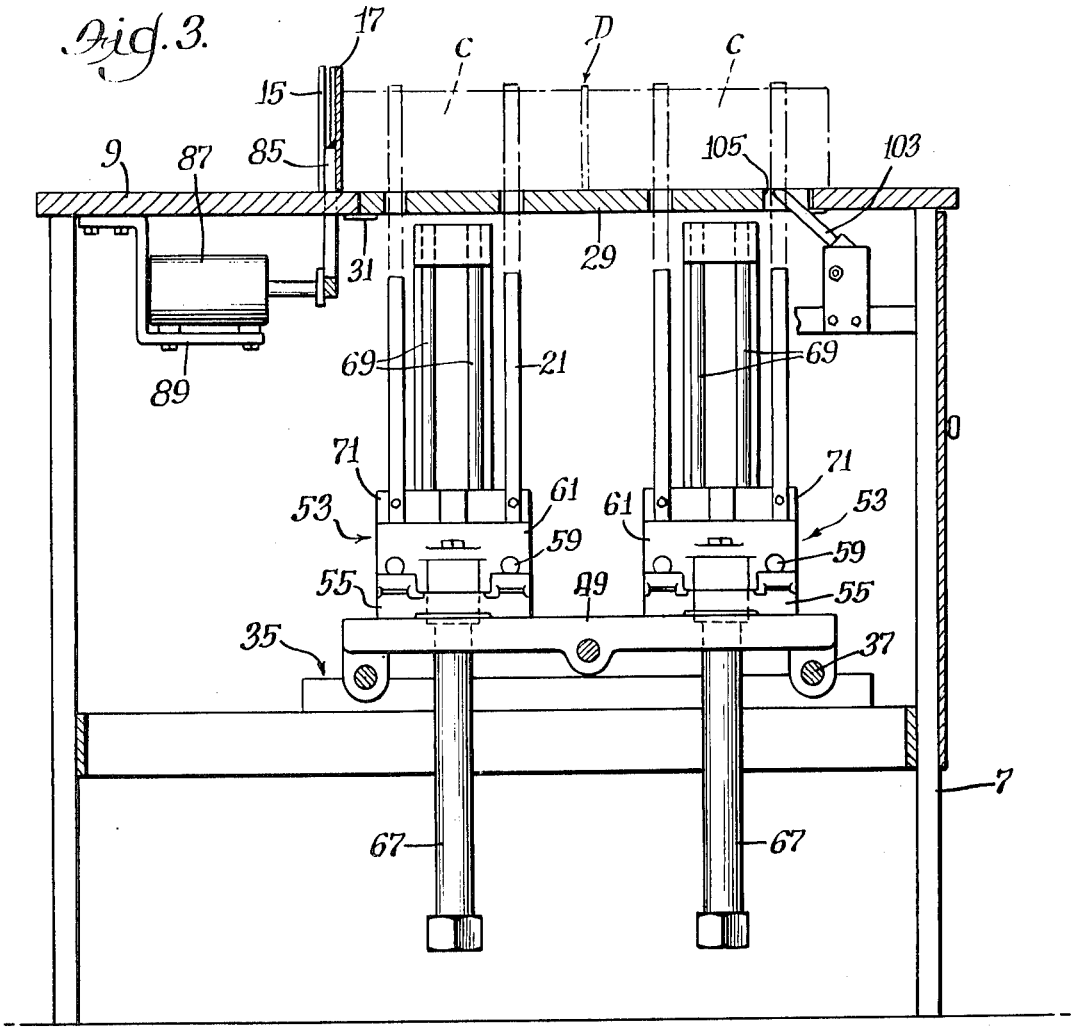
FIG. 3 is a sectional view taken along line 3—3 of FIG. 2 showing the apparatus adapted for packing two rows of flat articles.

As best seen in FIGS. 2 and 3, a base 35 is suitably affixed to the frame 7 of the apparatus, which base includes two parallel rods 37 of circular cross section. The front or right-hand end of the base 35 contains an upstanding bracket 39 which is affixed to a threaded nut 41. The nut 41 supports a long, threaded, adjusting screw 43 to which a handwheel 45 is affixed at the right end thereof.

The left-hand end of the adjusting screw 43 is suitably coupled to a depending apertured lug 47 on a carriage 49 which is slidably mounted to move longitudinally along the pair of parallel rods 37. The connection to the carriage 49 may be made via a thrust bearing and a collar. Thus, turning of the handwheel 45 causes the main carriage 49 to move longitudinally along the two rods 37 of the main base 35. It is by means of this adjustment that the precise location of the compression fingers 21 at the end of the compression strokes is determined. The main carriage 49 includes a pair of front and rear transverse support bars 51*a* and 51*b* and is otherwise open in its center. Both the front bar 51*a* and the rear bar 51*b* are drilled and tapped to provide a plurality of threaded holes spaced, for example, a half-inch apart.

The mechanism which moves the compression fingers 21 is modular in construction, and FIG. 3 shows two such modules 53 mounted upon the main carriage. Each module 53 contains an individual base 55 in the form of a generally rectangular frame which is open in its center. Each module base 55 is connected by four bolts 57 at the desired location on the main carriage 49, which bolts are received in the threaded holes in the support bars 51*a* and 51*b*. A pair of parallel slide rods 59 are bolted to the top of each module base 55, and a subcarriage 61 is mounted on the slide rods 59 for longitudinal movement therealong.

A small fluid-actuated cylinder 63, preferably a pneumatic cylinder, is bolted to the right-hand end of the subcarriage 61, and the piston of the cylinder 63 is connected by a coupling 65 to the right-hand end of the subcarriage. Accordingly, the subcarriage 61 will move longitudinally along the slide bars 59 on the module base 55 a distance equal to the stroke of the small air cylinder 63, as illustrated in dotted lines in FIG. 2. The subcarriage carries a vertically oriented fluid-actuated cylinder 67, preferably an air cylinder, which depends therefrom and which has a piston extending vertically upward. The subcarriage also includes two vertical rods 69 upon which a finger holder 71 is slidably mounted for reciprocating movement in the vertical direction. The bottom of the finger holder 71 is suitably coupled to the upper end of the piston of the fluid cylinder 67, and a pair of compression fingers 21 are suitably affixed at their lower ends to the holder 71, as by screws. When air pressure is applied to the lower end of the fluid cylinder 67, the piston is extended causing the finger holder 71 to travel upward on the vertical guide rods 69 so that the compression fingers 21 are extended to the upper position shown in the dotted lines. Provisions could be made to adjust the length of the upward stroke of the piston, as by mounting spacers atop the finger holders 71 which will limit its travel upward along the guide rods 69, or the height of the fingers 21 can be changed by substituting fingers of a different length.

A single vertically oriented pneumatic cylinder 73 (FIG. 2) is appropriately mounted to the frame 7 at a location generally below the left-hand edge of the cavity 27 in the table top, via mounting block 75. The mounting block 75 carries the vertically depending cylinder 73 plus a pair of vertical guide rods 77 which extend upward to a location just below the undersurface of the table top 9. An elongated carrier 79 is coupled to the upper end of the piston of the pneumatic cylinder 73, and it is slidably mounted for reciprocating movement along the pair of guide rods 77. The right-hand side of the carrier 79 is cut out to provide a ledge 81 upon which the lower ends of the abutment fingers 19 can be located, and the fingers are secured in their desired positions by horizontally extending bolts 83 which are threaded into tapped holes in the carrier. Nine such tapped holes are provided in the carrier 79, and each is spaced, for example, an inch and three-quarters apart and is in alignment with one of the nine round holes 23 that are provided in the interchangeable inserts 29.

All of the abutment fingers 19 travel upward or downward simultaneously, driven by the single pneumatic cylinder 73. Inasmuch as these fingers 19 are individually held only by a single bolt 83, they can easily be removed and/or repositioned as required to permit their location in the most favorable positions depending upon the number of rows of flat articles that are being packed and the dimensions of the individual articles. The stroke of the cylinder 73 can be adjusted, as suggested in respect of the vertical cylinders 67, or substitute fingers 19 can be used to accordingly change the height to which the fingers 19 will extend above the upper surface of the insert 29. As shown in FIGS. 2 and 3, the height of the fingers 19, 21 in their extended positions should be about equal to or just slightly below the upper edges of the articles C that are being packed.

Figure 4:
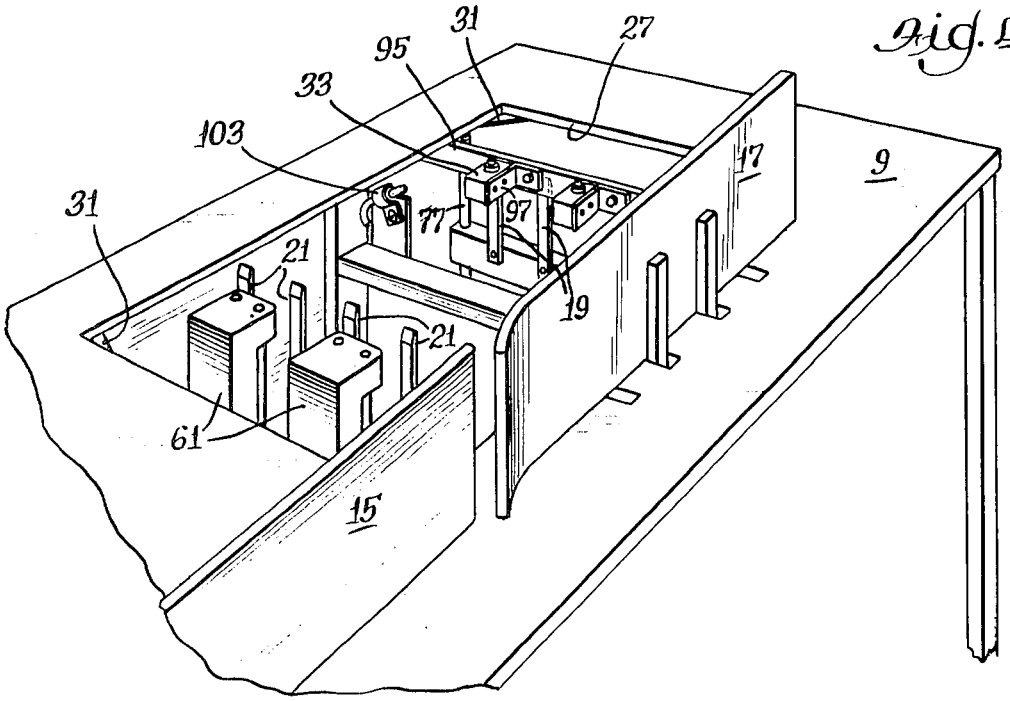
FIG. 4 is a rear perspective view shown looking into the apparatus depicted in FIG. 3 with its upper insert plate removed.

Mention was earlier made to the moveable backing plate section 17 which is located adjacent the packing region 13 defined by the interchangeable insert, and as best seen in FIGS. 2 and 3, the moveable section 17 is supported via a yoke arrangement 85 which is coupled to the end of the piston of a small pneumatic cylinder 87 which is mounted by a bracket 89 affixed to the underside of the table top 9. In its extended position, as shown in FIG. 3, the moveable backing plate section 17 lies just slightly in front of the stationary backing plate 15. When the piston of the pneumatic cylinder 87 is retracted, as shown in FIG. 4, the moveable section 17 is withdrawn from its position adjacent the rows of articles to allow clearance for the wall of a corrugated box or other container which is being placed over the rows of blanks that are now ready for packing.

An electrical control system is provided which includes a front control panel 91 that is mounted in the front wall of the cabinet adjacent the right-hand end thereof. A microswitch 93 and an associated hinged actuator 93*a* are supported in the table top so that the actuator protrudes slightly above the upper surface at a location between the receiving region 11 and the packing region 13. The microswitch 93 is electrically connected to the control system and is similar in construction to the switches 33 which are associated with each of the sets of slots 25 in the insert 29.

The switches 33 are appropriately mounted to a bar 95 which is affixed to the frame at a location just below the undersurface of the interchangeable insert plate. The switches 33 are affixed to brackets 97 which are mounted by screws at the appropriate location transversely along the bar 95. Each of the switches 33 is a microswitch which is actuated by the depression of a flexible hinged actuator member **33*a* which is appropriately mounted, as best seen in FIG. 2, to generally fill a small rectangular aperture in the interchangeable insert 29. An additional microswitch 99 and a similar associated hinged actuator 99*a* is provided in a location along the rear edge of the interchangeable insert 29, generally in alignment with the transverse row of round holes 23. One further switch 101 is mounted in the front wall of the cabinet of the frame adjacent the packing region 13** and is adapted for actuation by the hand or leg of the operator.

Figure 5:
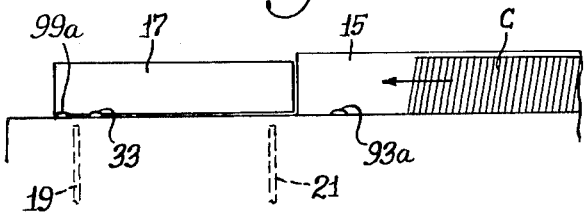
FIGS. 5 through 10 are diagrammatic side elevational views illustrating the use of the apparatus depicted in FIG. 1 for packing multiple rows of carton blanks.
Figure 6:
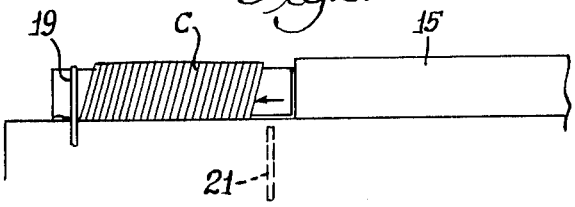
Figure 7:
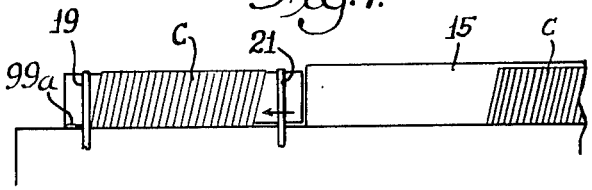
Figure 11:
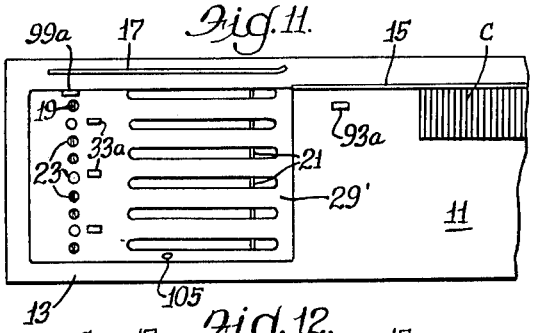
FIGS. 11 through 16 are diagrammatic views, shown in plan, which illustrate the packing of three rows of carton blanks in a single box.
Figure 12:
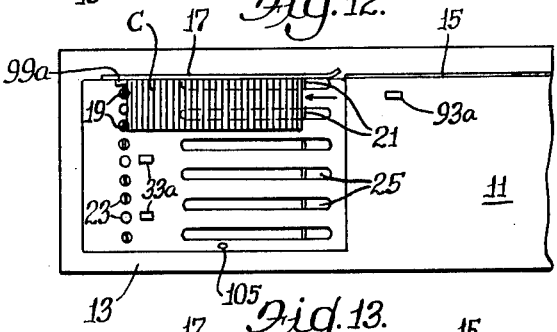

The sequence of operation is illustrated in FIGS. 5 through 16 where the insert plate 29' is placed in the cavity 27 to adapt the apparatus 5 for use in packing three rows of carton blanks. The control panel 91 is set to place the apparatus in the ready position as depicted in FIGS. 5 and 11. In this position, the moveable backing plate section 17 is in its retracted location, set slightly back of the stationary backing plate 15, and the abutment fingers 19 and the compression fingers 21 are all in the retracted position, below the surface of the table top 9. The operator grasps the nearest set of folded carton blanks C at the receiving region 11 of the table top and slides them toward the packing region 13. As the blanks pass over and actuate the first switch 93, the control system opens solenoid-actuated valves to feed compressed air to the vertical cylinder 73 and to the small horizontal cylinder 87, causing the pistons of both of these cylinders to extend. As a result, the carrier 79 is driven upward extending six abutment fingers 19 through round holes 23 in the insert plate with which they register, and the moveable backing plate section 17 is driven forward to the position as shown in FIGS. 12 through 15. At the same time, compressed air is supplied to an air nozzle 103 which is mounted to the frame 7 at a location just below the cavity 27 (see FIG. 4). The nozzle 103 directs a stream of air through a hole 105 in the insert and transversely across the upper surface thereof.

Figure 8:
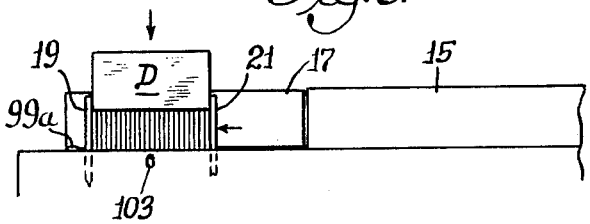
Figure 9:
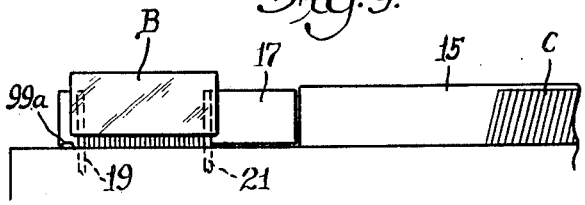
Figure 10:
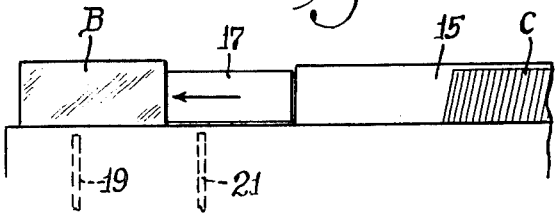

As the operator arranges the group of blanks in a row against the two rearwardmost abutment fingers 19 and the moveable backing plate section 17, the microswitch 33 is actuated which causes the compression fingers 21 carried by the rearward module 53 to be raised by applying air pressure to the vertical cylinder 67 to drive its piston upward. At about the time the vertical position reaches the top of its stroke, the shorter, horizontal cylinder 63 is actuated to cause the extended compression fingers 21 to move longitudinally to the left, thus compressing the articles to the ultimate position as shown in FIG. 8. At this time a suitable divider D, such as a panel of corrugated fiberboard of appropriate height and length, is placed adjacent the compressed row of blanks, as shown in FIG. 8, and it remains in this vertical position, being pressed against the edge of the compressed row of blanks by the stream of air from the air nozzle 103 which is being blown transversely across the surface of the insert 29' in the packing region 13.

Figure 13:
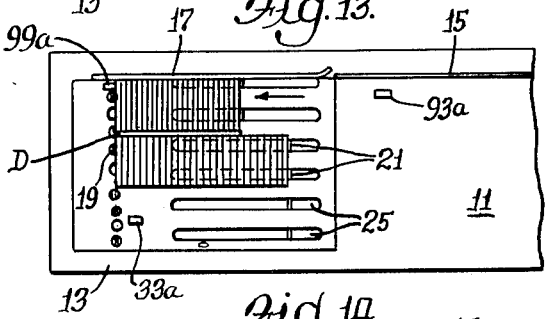
Figure 14:
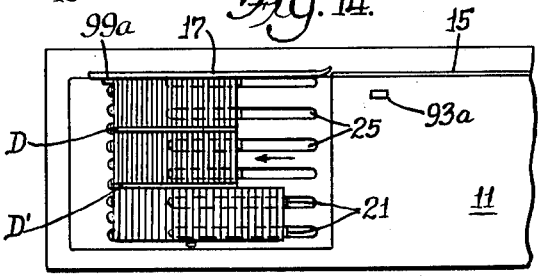
Figure 15:
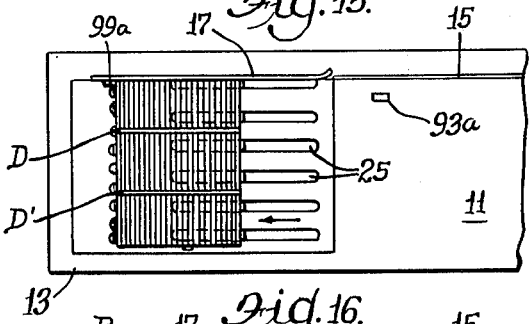

The operator then slides the next group of carton blanks from the receiving region 11 to the packing region 13, and if the switch 93 is actuated, it has no effect inasmuch as the control system has already opened the valves so that compressed air continues to be applied to the cylinders 73 and 87. However, when the group reaches the switch 33 adjacent the abutment fingers 19, the control system actuates the centrally located module 53. Accordingly, as the operator aligns this row of blanks against the abutment fingers 19 on the left and the divider pad D, the compression fingers 21 are driven to their raised position, as shown in FIG. 13, and then to the left to compress the second row of carton blanks as depicted in FIG. 14. The operator next places a second divider pad D' adjacent the forward facing edge of the second row of blanks, and it is likewise held in vertical position against the edge of the row of blanks by the air stream created by the air nozzle 103.

The operation is then repeated with a third group of folded carton blanks, and the actuation of the switch 33 adjacent the third set of abutment fingers 19 causes the control system to actuate the forward module 53 so that the final set of two compression fingers 21 is extended upward as the operator arranges the carton blanks in a row against the abutment fingers and the second separator pad D' as generally shown in FIG. 14. After the final set of compression fingers 21 has been driven to the left, the three rows of blanks are ready for boxing.

Figure 16:
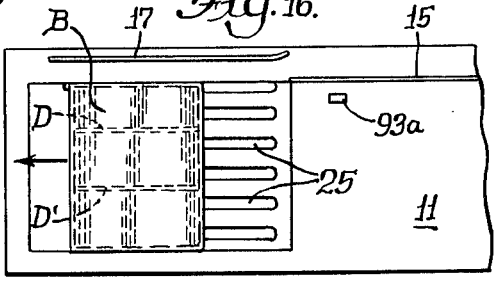

The operator hits the front switch 101 which causes the horizontal cylinder 87 to retract its piston, moving the moveable backing plate section 17 to the retracted position shown in FIG. 16. The operator then places an inverted box B of appropriate size and depth, such as a regular slotted corrugated container, over the assembly. The downward movement of the box B is guided by the chamfered upper ends of the abutment and compression fingers 19, 21. When the lower edge of the inverted box reaches the upper surface of the insert 29', the final microswitch 99 is actuated, causing all of the fingers 19, 21 to retract to the lowered position shown in FIG. 10. The operator then pushes the box to the left, preferably upon a box inverter of standard design that will discharge it onto a conveyor.

Although the apparatus operation is illustrated with respect to a three-line packing arrangement, it can be easily converted to either a one-row or a two-row packing operation by substituting another interchangeable insert for the three-row insert 29' depicted in FIGS. 5 through 16. The unneeded modules 53 can be quickly removed, and the remaining modules 53 repositioned as required for alignment with the slots in the substituted insert plate. It will likely not be necessary to reposition the rear abutment fingers; however, they can be simply either removed or moved to align with a different hole 23 by manipulation of a single screw. Realignment of the microswitches 33 which are located adjacent the abutment fingers 19 is also simply accomplished. The control system is easily set for one, two or three-row operation by the knobs on the front panel 91.

Although the apparatus has been described with regard to certain preferred embodiments, it should be understood that modifications as would be obvious to one having the ordinary skill in the art may be made without departing from the scope of the invention which is defined solely by the claims appended hereto.

Various of the features of the invention are set forth in the claims which follow

What is claimed is:

1. Apparatus for packing stacks of flat articles in a box, which apparatus comprises a frame having a flat upper surface including a receiving region and a packing region spaced longitudinally from each other, and first switch means located between said regions and protruding from the surface thereof, at least two sets of rear abutment fingers, means mounting said rear fingers for movement between raised positions extending upward through holes in said upper surface and retracted positions below said upper surface, at least two sets of front compression fingers aligned with longitudinally elongated apertures in said upper surface, means mounting said front compression fingers for extension to a raised position above said upper surface and for retraction to a lower position below said upper surface, means for moving said sets of front fingers longitudinally of said upper surface, second switch means extending above said upper surface in association with each set of said rear abutment fingers, a control system connected to said first and second switch means so that actuation of said first switch means by sliding movement thereover of a first stack of flat articles causes extension of said rear abutment fingers and actuation of said second switch means adjacent a first set of said rear fingers causes extension of a first set of said front compression fingers and longitudinal movement thereof to compress the first stack of articles therebetween, and so that subsequent actuation of said second switch means adjacent a second set of rear abutment fingers by sliding movement of a second stack of flat articles thereover causes extension of a second set of said front compression fingers and longitudinal movement thereof to compress the second stack therebetween, and air nozzle means mounted on said frame for blowing a stream of air transversely across said upper surface so as to hold a flat divider in vertical orientation against said compressed first stack of articles to provide a separator and guide against which the second stack of articles can be evenly arranged in abutting contact.

2. Apparatus in accordance with claim 1 wherein said control system applies air pressure to said air nozzle means upon actuation of said first switch.

3. Apparatus for packing stacks of flat articles in a box, which apparatus comprises a frame having a flat upper surface including a receiving region and a packing region spaced longitudinally from each other, and first switch means located between said regions and protruding from the surface thereof, at least two sets of rear abutment fingers, means mounting said rear fingers for movement between raised positions extending upward through holes in said upper surface and retracted positions below said upper surface, at least two sets of front compression fingers aligned with longitudinally elongated apertures in said upper surface, each set of said front compression fingers being a part of an individual module which is removably mounted to said frame, said module including a generally vertically disposed fluid-actuated cylinder for extension of said fingers to a raised position above said upper surface and for retraction to a lower position below said upper surface and a generally horizontally mounted fluid-actuated cylinder for movement of said front compression fingers longitudinally of said upper surface, second switch means extending above said upper surface in association with each set of said rear abutment fingers, and a control system connected to said first and second switch means so that actuation of said first switch means by sliding movement thereover of a first stack of flat articles causes extension of said rear abutment fingers and actuation of said second switch means adjacent a first set of said rear fingers causes extension of a first set of said front compression fingers and longitudinal movement thereof to compress the first stack of articles therebetween, and so that subsequent actuation of said second switch means adjacent a second set of rear abutment fingers by sliding movement of a second stack of flat articles thereover causes extension of a second set of said front compression fingers and longitudinal movement thereof to compress the second stack therebetween, and said upper surface of said frame having a cavity therein in the packing region thereof and a pair of interchangeable inserts being provided which fit into said cavity, one of said inserts containing holes and elongated apertures to accommodate at least two sets of compression fingers and the other insert containing holes and elongated apertures to accommodate a different number of sets of compression fingers, said frame including support means for mounting said modules at different transverse locations so as to align said front compression fingers with said elongated apertures in said different interchangeable inserts.

4. Apparatus in accordance with claim 3 wherein said support means is mounted on a carriage which is supported upon said frame for longitudinal movement and wherein adjusting means is provided for the longitudinal position of said carriage to accommodate different lengths of stacks of flat articles for packing in different size boxes.

5. Apparatus in accordance with claim 4 wherein said carriage is mounted upon a base which includes a pair of longitudinally extending bars for slidable movement therealong and wherein a threaded shaft to which handwheel means is attached interconnects said base and said carriage for slidable relative movement.

* * * * *